US005332986A

United States Patent [19]

Wieloch

[11] Patent Number: 5,332,986

[45] Date of Patent: Jul. 26, 1994

[54] OVERLOAD RELAY MECHANISM

[75] Inventor: Christopher J. Wieloch, Brookfield, Wis.

[73] Assignee: Allen-Bradley Company, Inc., Milwaukee, Wis.

[21] Appl. No.: 46,680

[22] Filed: Apr. 13, 1993

[51] Int. Cl.[5] ..... H01H 51/22

[52] U.S. Cl. ..... 335/78; 335/80; 335/128

[58] Field of Search ..... 335/78-86, 335/124, 128, 131

[56] References Cited

U.S. PATENT DOCUMENTS 5,227,750 7/1993 Connell et al. ..... 335/86

*Primary Examiner*—Lincoln Donovan

*Attorney, Agent, or Firm*—John J. Horn; H. Frederick Hamann; Keith M. Baxter

[57] ABSTRACT

A mechanism for an overload relay or the like employs a contact bar that is held in a reset position by magnetic attraction and in a tripped position by the biasing of a spring. The magnetic attraction effective in the reset condition may be overcome by a countervailing magnetic field developed by a coil driven in turn by overload sensing circuitry, or by the mechanical displacement of the contact bar away from the reset position by any small amount. Resetting is accomplished by another magnetic linkage which also may be subject to the countervailing field of the coil to prevent resetting during an overload condition.

9 Claims, 3 Drawing Sheets

OVERLOAD RELAY MECHANISM

BACKGROUND OF THE INVENTION

1. Field of the Invention

The present invention relates to a mechanism for a bi-stable electrical relay and in particular a mechanism useful for overload relays such as are used to protect motors from overload or fault currents.

2. Background Art

Overload relays are specialized circuit breakers used with industrial motors to protect the motors from damages caused by overload or electrical faults. Typically, such motors are connected to a source of three-phase power through a contactor. In this case, the contactor is a heavy duty relay having three contact sets for breaking each of the three-phases of power upon movement of a yoke member within a contactor coil, the yoke member and coil together forming an electrical solenoid. The coil may be energized, and thus the contactor controlled, by current from a remote set of switches.

A contact of an overload relay is typically connected in series with the coil of the contactor to cause the contactor to open when an overload condition is sensed. The overload relay senses an overload condition by monitoring the current in each of the three-phases received by the motor windings. In the simplest case, the overload relay incorporates resistive heaters for each phase which are thermally coupled to one or more bi-metallic elements. An overload condition is indicated when the time integral of the motor current exceeds a predetermined value, the time integral being represented by the temperature of the resistive heaters. When an overload is sensed, the bimetallic switch opens, de-energizing the contactor coil and causing the motor to be disconnected from the line.

With advances in electronic circuitry, the bi-metallic element has been replaced with more complex circuitry. Such circuitry may sample current flow to the motor on a periodic basis and provide sophisticated overload prediction based not only on a simple thresholding but on more complex trend analyses. The output of this circuitry is typically a low-powered overload signal. In order for this overload signal to control the contactor coil current, a solid state switch may be required, adding to the complexity and cost of the overload relay.

Once "tripped" the overload relay remains in the open position and must be manually reset. Resetting is typically accomplished by a mechanical push button. When the reset push button is pushed, the contacts of the overload relay allow current to again flow through the contactor to the motor.

It is desirable that the connection of the reset button to the overload relay contacts be such that the contacts may open in the event of an overload even when the reset button is depressed. This prevents damage to the motor if an overload condition occurs or continues during a resetting of the overload relay, and more generally prevents the protective purpose of the overload relay from being defeated by a holding down or jamming of the reset button. This operability despite the pressing of the reset button is termed "trip free".

It is also desirable that the overload relay switch have a test button that allows testing of the contacts of the overload relay without the creation of an actual overload condition. When the overload relay switch is open by the test button, it should remain in the open position until it is reset, in a manner analogous as far as possible the opening caused by an actual overload condition.

The desire that an overload relay accept electrical overload signals such as from sophisticated overload detection circuitry, together with the requirements imposed by the reset and test buttons, and the requirement to make and break loads of as much as 600 volts, seems to demand a complex electromechanical mechanism with numerous parts, or an expensive all solid state device. Either alternative is expensive and may decrease the reliability of the overload relay.

SUMMARY OF THE INVENTION

The present invention provides a simple overload relay mechanism that has test and reset buttons and is well adapted for triggering by an electrical signal developed from sophisticated electronic overload circuitry. The invention employs magnetic linkages which may be either mechanically broken, and hence overridden in the case of testing or of resetting during an overload condition, or electrically broken by a signal from overload detection circuitry.

Specifically, the overload relay of the present invention employs a contact pair linked to an actuator bar. When the actuator bar is in a first position, a yoke member magnetically attracts the actuator bar against the bias of a spring. Otherwise, the spring works to move the actuator bar to the second position. When the actuator bar moves between a first and second position the contacts open and close.

A coil wound around the yoke member may produce a magnetic field reducing the magnetic attraction between the yoke member and the actuator bar when the actuator bar is in the first position thereby allowing the actuator bar to move to the second position under the influence of the spring. Alternatively, the actuator bar may be moved from the first to the second position, without current flow through the coil, by a mechanical overriding of the magnetic attraction with a test button or the like.

It is a first object of the invention to provide a bi-stable linkage that is amenable to being overridden. The magnetic attraction between the actuator bar and the yoke member provides bi-stability. The magnetic attraction is local and thus the magnetic attraction which holds the actuator bar in the first position does not substantially affect the actuator bar when it is in the second position. In either stable position, the actuator bar may be overridden and moved to the other position by sufficient mechanical force, either to overcome the biasing of the spring or to break the magnetic attraction between the actuator bar and the yoke member.

It is another object of the invention to provide a mechanism that may be activated electrically as well as mechanically. The actuator bar may be moved from the first to the second position by an electrical current passing through the coil, thus adapting the linkage to being driven by sophisticated electronic overload sensing circuits.

A follower may be attached to the actuator bar by magnetic attraction to be able to move with the actuator bar between the first and second positions. A reset button communicating with the follower may be used to return the follower and hence the actuator bar from the second to the first position.

It is another object of the invention to provide a resetting mechanism that is subservient to a testing mechanism. A test button may be mechanically tied to the actuator bar and the button only linked magnetically and thus the actuator bar will yield to forces applied by the test button in opposition to forces applied by the resetting button.

The follower may pass through the coil, and the reducing magnetic field generated by the coil may also cancel the magnetic attraction between the follower and the actuator bar.

It is thus another object of the invention to provide a mechanism for resetting an overload relay switch that is subservient to an electrical overload signal. When there is an electrical overload signal, the coil that triggers the overload relay also cancels the magnetic attraction between the follower and the actuator bar. This prevents the resetting of the overload relay during an overload condition and prevents the reset button from defeating the overload relay.

The reset button may include a provision for restraining the follower from following the actuator bar to the second position.

It is thus another object of the invention to permit electronic resetting of the actuator bar. When the follower is so restrained, a pulse of current in the coil may be used to attract the actuator bar back to the first position. When the follower is not so restrained, the attracting force produced by the resetting pulse is shorted magnetically by the bridging action of the follower, preventing the resetting.

It is thus another object of the invention to provide a mechanical means of programming the overload relay to automatically reset or not, depending on the physical position of the follower (as controlled by the reset button) without electrical communication to controlling circuitry. A reset pulse may always be provided to the coil and whether it is effective depends simply on whether the follower has been restrained.

The foregoing and other objects and advantages of the invention will appear from the following description. In the description, reference is made to the accompanying drawings which form a part hereof and in which there is shown by way of illustration several preferred embodiments of the invention. Such embodiments do not necessarily represent the full scope of the invention, however, and reference must be made therefore to the claims herein for interpreting the scope of the invention.

DETAILED DESCRIPTION OF THE PREFERRED EMBODIMENT

Figure 1:
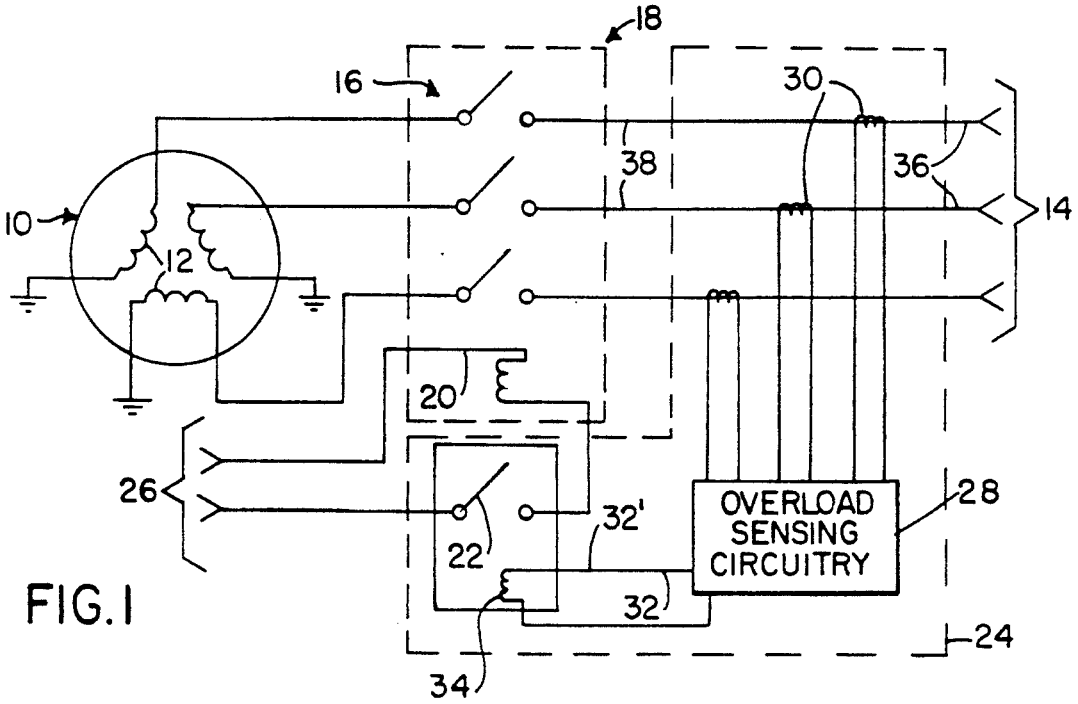
FIG. 1 is a schematic view of a three-phase motor as connected to three-phase power through a contactor associated with an overload relay of the present invention.

Referring to FIG. 1, a three-phase motor 10 has a set of three windings 12 for receiving three-phase power 14 through three contacts 16 of a contactor 18 placed in series between the three-phase power 14 and the windings 12. The contacts 16 of the contactor 18 are controlled by coil 20 within the contactor 18 which pulls the contacts 16 closed when current flows through its windings as is generally understood in the art.

Coil 20 is connected in series with contacts 22 of an overload relay 24. The contacts 22 are normally closed so as to allow power from a remote control source 26 (typically a push button or the like) to energize the coil 20 absent any overload condition.

Overload relay 24 includes overload sensing circuitry 28 which monitors the current through the windings 12 by means of current transformers 30. Such circuitry 28, as is known in the art, may calculate a heating value of the current to the windings 12 to produce a overload signal 32 if the heating value of the current through any winding 12 exceeds a predetermined threshold. The overload signal 32 drives an overload relay coil 34 so as to open overload relay contacts 22 if the threshold heating value is exceeded. Thus, if an overload is sensed by the sensing circuitry 28, contact 22 is opened, de-energizing coil 20 of the contactor 18 and disconnecting the windings 12 of the motor 10 from three-phase power 14.

Figure 2:
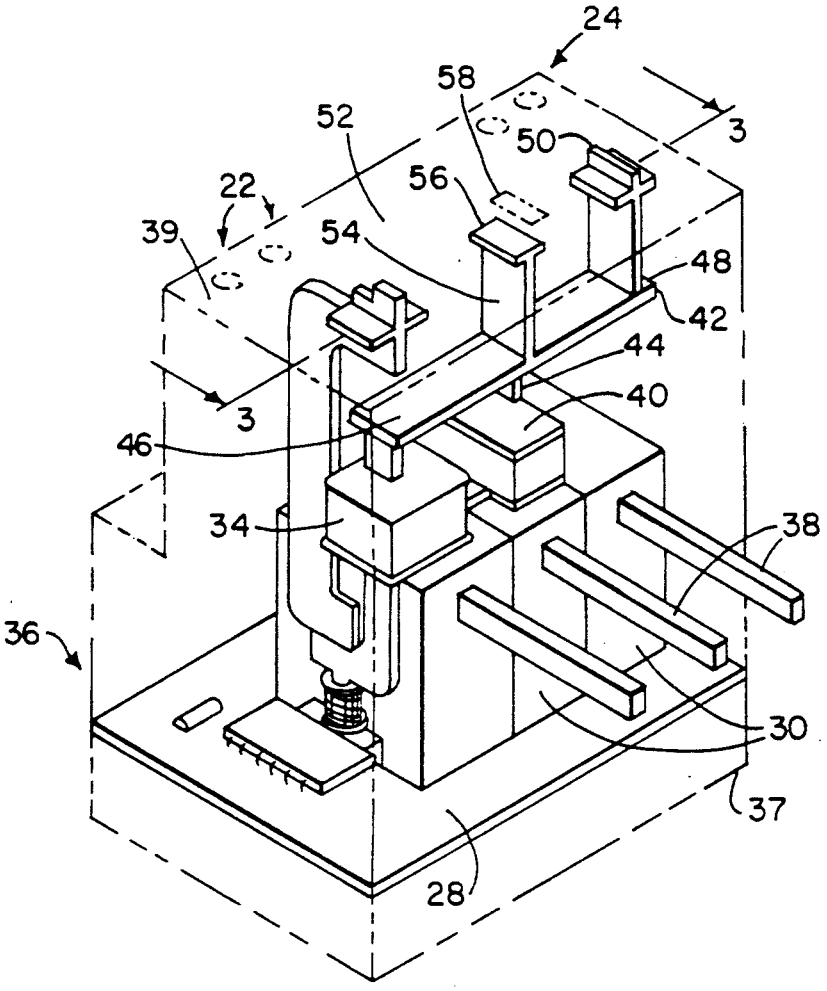
FIG. 2 is a perspective view in phantom of the overload relay of FIG. 1 showing the general layout of the principal elements of the overload relay mechanism including an actuator bar, a permanent magnet and an electromagnet.

Referring now to FIGS. 1 and 2, overload relay 24 is contained in a housing 37 that may be attached to a contactor to receive three-phase power 14 at connectors 36 and to communicate that power 14 to the contacts 16 of the contactor 18 via pins 38 after passing through current transformers 30. Positioned above the current transformers 30, within the housing 37 of the overload relay 24 is an actuator mechanism which includes coil 34, permanent magnet 40 and actuator bar 42. The actuator bar 42 pivots about and above a fulcrum 44 which sits atop permanent magnet 40 and approximately bisects the actuator bar 42.

A first end 46 of the actuator bar 42 may swing up and down to abut the top of coil 34. A second end 48 of the actuator bar 42 is positioned beneath a test button 50 that protrudes out of the housing top 39 of the overload relay 24 and when depressed pushes the second end 48 downward raising the first end 46 away from the coil 34. A reset button 52 also protrudes from the housing top 39 of the overload relay 24 above the first end 46 of the actuator bar 42. As will be described in detail below, depressing the reset button 52 under certain circumstances will move the first end 46 of the actuator bar 42 downward toward the coil 34.

Centered above the fulcrum 44 and attached to the actuator bar 42 to extend upward from the actuator 42 is a flag support 54 which holds a flag 56 beneath an aperture 58 to indicate the position of the actuator bar 42 with respect to that aperture 58 as will be described in detail below.

Figure 3:
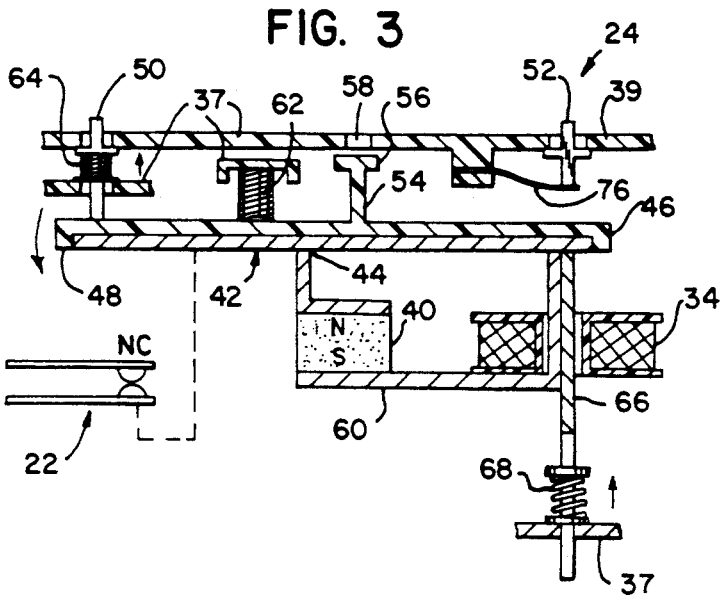
FIG. 3 is a elevational view along cross-sectional line 3—3 of FIG. 2 showing the actuator bar positioned with respect to the electromagnet in an untripped state.
Figure 4:
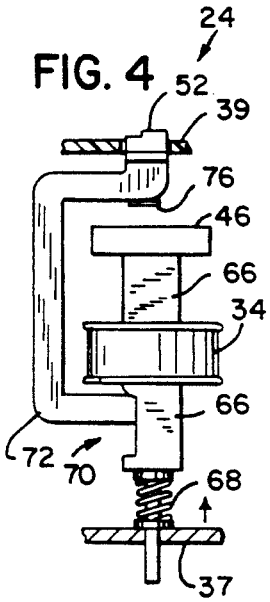
FIG. 4 is a view similar to that of FIG. 3 but showing a side view of the overload relay mechanism in the untripped state.

Referring now to FIGS. 3 and 4, contacts 22 are connected to actuator bar 42 so that pivoting of actuator bar 42 about fulcrum 44 opens and closes contacts 22. When the contacts 22 are closed in the reset state, the actuator bar 42 is substantially horizontal with respect to the housing top 39 and the first end 46 of the actuator bar is proximate to the coil 34.

Figure 5:
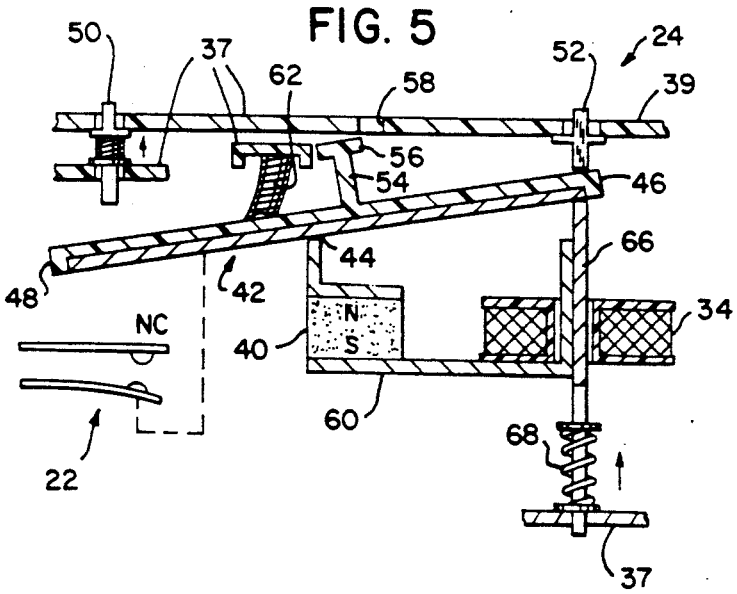
FIG. 5 is a figure similar to FIG. 3 showing the actuator bar in the tripped state.

In contrast, referring briefly to FIG. 5, in a tripped state, contacts 22 are open preventing current from flowing through the coil 20 of the contactor 18 and actuator bar 42 is tipped from its horizontal position with respect to the housing top 39 with first end 46 displaced upward away from coil 34 and towards housing top 39.

Referring again to FIG. 3 and 4, actuator bar 42 is constructed of an elongate rectangular bar of soft steel notched along its midpoint to fit against fulcrum 44 and to toggle thereabout without slipping. Attached to the upper surface of this bar is a conforming plastic cap of comparable dimensions incorporating embossments for the holding of springs, and the flag support 54.

Fulcrum 44, also constructed of a magnetizable steel, is L shaped with a vertical leg fitting into the notch in the actuator bar 42 and a horizontal leg capping the north pole of permanent magnet 40. The south pole of the magnet 40 abuts the top of a yoke member 60, being generally a horizontally disposed bar of steel which extends horizontally to beneath the center of coil 34 and then passes upward through the center of coil 34 to abut the first end 46 of the actuator bar 42 when the actuator bar 42 is in the reset state. It will be recognized from the following discussion that the north and south poles of the permanent magnet 40 may be reversed provided similar polarity changes are made in the current flows through coil 34 to be described.

It will be understood that in combination the yoke member 60, fulcrum 44 and actuator bar 42 form a closed magnetic circuit when the actuator bar 42 is in the reset state and therefore that actuator bar 42 is attracted to and may be held firmly against the yoke member 60 at the first end 46 of the actuator bar 42 by magnetic attraction.

A compression spring 62 positioned between the fulcrum 44 and the second end 48 of the actuator bar 42 presses downward on the upper surface of the actuator bar 42 so as to bias the second end 48 downward and the first end 46 upward and away from yoke member 60. The force of the spring 62 is such that it is insufficient to overcome the attraction between the yoke member 60 and the actuator bar 42 when the actuator bar 42 abuts the yoke member 60.

Test button 50 extending through the housing top 39 is biased upward against the housing top 39 by a second compression spring 64. In a second embodiment, the compression spring 64 may be the same as compression spring 62. The test button 50 extends downward to abut the upper surface of the second end 48 of the actuator bar 42 so that when the test button is depressed, it moves the actuator 42 to the trip position as shown generally in FIG. 5.

Referring still to FIGS. 3 and 4, the coil 34 center large enough to accommodate not only the yoke member 60 but a steel follower 66 which slides against the yoke member 60 as it passes through the coil 34 and has one end also abutting the steel portion of the actuator bar 42 at its first end 46. In the reset state, the magnetic flux from the permanent magnet 40 passes both through the yoke member 60 and through the follower 66 and thus the actuator 42 is attracted both to the yoke member 60 and the follower 66. The follower 66 is biased upward by a spring 68 and thus exerts an upward force against the first end 46 of the actuator 42 but this force, even together with that exerted by spring 62 on the opposite side of fulcrum 44, is insufficient to break the magnetic attraction between the yoke member 60 and the actuator bar 42.

The follower 66 includes a vertically disposed slot 70 which receives a pawl 72 attached to the reset button 52. When the actuator bar 42 is in its reset position, the pawl 72 is in the uppermost extent of the slot 70 and pushing down of the reset button 52 only moves the pawl 72 to the bottommost extent of the slot 70 without moving the follower 66. Reset button 52 is biased upward against the housing top 39 by a leaf spring 76.

In the reset position, the flag support 54 is substantially vertical and holds the flag directly beneath aperture 58. Flag 56 may be colored so as to provide a visual indication that the overload relay 24 is in the reset position.

Referring now to FIG. 5, the actuator arm 49, upon the occurrence of one of two conditions, may be moved to the tripped position in which its first end 46 is moved upward towards the housing top 39, away from the yoke member 60, and its second end 48 is moved downward away from the housing top 39. The first condition is the depression of the test button 50 which moves second end 48 of the actuator arm 49 downward and mechanically overcomes the magnetic attraction between the yoke member 60 and the first end 46 of the actuator arm 49. Because of the rapid fall off in magnetic field strength, once the first end 46 no longer abuts the yoke member 60, the springs 62 and 68 are sufficient to continue to move the actuator 42 fully to the tripped state.

The actuator bar 42 may also be moved to the tripped position by current flow through coil 34 which generates a magnetic field in yoke member 60 and follower 66 opposite to that generated by permanent magnet 40. This current, provided by the overload sensing circuitry 28, electrically breaks the magnetic attraction between the yoke member 60 and the first end 46 of the actuator bar 42 also allowing it to move the tripped position. It will be noted that the current in coil 34 need only be sufficient in duration to allow the actuator 42 to begin its travel to the tripped position because the magnetic field generated by permanent magnet 40 is generally too weak to draw the first end 46 back to the yoke member 60 after a small gap between them (about 0.020 inches) has been created.

Thus, the actuator bar 42 is bi-stable in either the reset or the tripped positions. As noted before, in the tripped position as shown in FIG. 5, contacts 22 are opened and thus no current may flow through coil 20 of a connected contactor 18 effectively disconnecting the motor 10 from potentially damaging overload currents.

When the actuator bar 42 moves to the tripped position with the first end 46 displaced towards the housing top 39, the follower 66 slides against the yoke member 60 as it passes through the coil 34 and follows the first end 46 upward under the biasing of spring 68. Thus, follower 66 follows first end 46 to the tripped position. At the conclusion of the current flow through coil 34, follower 66 is magnetically attracted to the actuator bar 42. The follower closes the flux path produced by permanent magnet 40 and carried along a path formed from yoke member 60, follower 66, actuator bar 42 and fulcrum 44.

In the tripped position, flag support 54 attached to the upper surface of the actuator 42, is displaced from a vertical position and thus moves flag 56 away from aperture 58 providing a visual indication that the overload relay 24 is in the tripped position.

Figure 6:
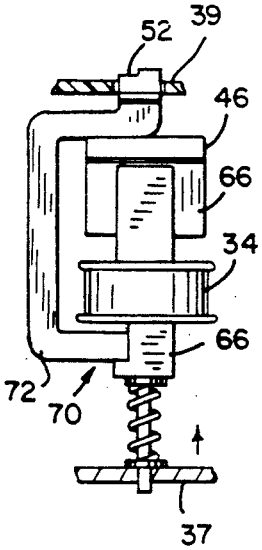
FIG. 6 is a figure similar to FIG. 4 showing the mechanism in the tripped state per FIG. 5.

Referring now to FIG. 6, in the tripped position, the slot 70 has moved upward with follower 66 so that the pawl 72 of the reset button 52, although unmoved, is now positioned against the bottom portion of the slot 70. When an overload condition ceases to exist and no current flows through coil 34, the magnetic attraction between follower 66 and the first end 46 of the actuator bar 42 is sufficient so that when the follower 66 is moved downward the first end 46 of the actuator bar 42 moves with it. The follower 66 may be so moved by the depression of the reset button 52 which communicates via pawl 72 to slot 70. In the resetting of the overload relay 24, follower 66 pulls the first end 46 of the actuator bar 42 downward again to abut yoke member 60 against the force of spring 62 alone.

Figure 7:
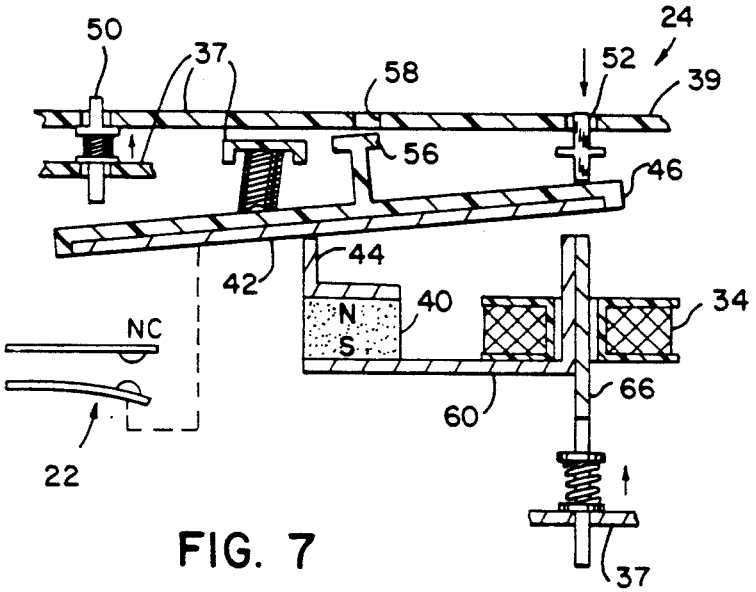
FIG. 7 is a figure similar to FIG. 3 showing the actuator bar in the tripped state with the reset button depressed.
Figure 8:
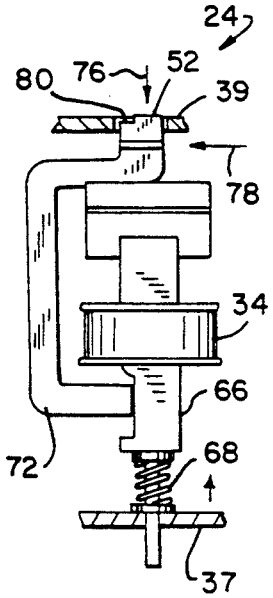
FIG. 8 is a figure similar to that of FIGS. 4 and 6 but showing the actuator bar in the tripped state of FIG. 7 with the reset button depressed.

Referring now to FIGS. 7 and 8, if the overload condition is still present during the resetting and current still flows through coil 34, or more typically, if the overload condition first occurs when the reset 52 is depressed, then as described above, coil 34 will generate an opposite flux in yoke member 60 and follower 66 that reduces the flux generated by permanent 40 through those members. This will cause the follower 66 to be no longer magnetically attracted to the first end 46 of actuator bar 42 and thus depression of the reset button 52 not to draw the first end 46 of the actuator 42 downward to yoke member 60. Thus an overload condition will always override the action of the reset button 52.

Likewise, depression of the test button 50 and reset button 52 at the same time will cause follower 66 to release the first end 46 of the actuator 42 preventing a resetting of the actuator bar 42 at that time.

Referring still to FIGS. 7 and 8, and also to FIG. 1, when the reset button 52 is depressed by a downward pressure indicated by arrow 76, it may be locked in a down position by a lateral force indicated by arrow 78 which pushes a lip 80 of the reset button 52 beneath the housing top 39 to prevent the spring 68 from returning the reset button 52 to a position protruding from the housing top 39 as a result of the force of spring 68 on follower 66 which presses upward on pall 72.

As described before, this locked position will not affect the tripping of the overload relay, however, it does provide the ability over the overload sensing circuitry 28 to automatically reset the overload relay, electronically, after a predetermined period of time after an overload has occurred. Specifically, overload sensing circuitry 28, after producing an overload signal 32, and after a predetermined time typically on the order of one to three minutes, produces a reset signal 32' having the opposite polarity of the overload signal 32. The effect of reset signal 32' is to produce a magnetic field in coil 34 that does not reduce the flux of yoke member 60 generated by permanent magnet 40 but that augments that flux to provide additional attractive force between the yoke member 60 and the first end 46 of the actuator bar 42.

The movement of the actuator bar 42 is limited so that the first end 46 is within the range of the magnetic attraction of the yoke member 60 when the reset pulse is received. Thus, the first end 46 of the actuator bar 42 can be drawn back to the yoke member 60.

If the reset button 52 is not locked down, then as shown in FIGS. 5 and 6, the follower 66 bridges the gap between the yoke member 60 and the first end 46 of the actuator bar 42. This bridging effectively prevents the retraction of the first end 46 against the yoke member 60 upon receipt of the reset pulse 32' by coil 34 by lessening the attractive force.

Accordingly, the overload sensing circuitry 28 will always produce a reset pulse after the predetermined time. But a resetting will only occur if reset button 52 is locked down, withdrawing follower 66 from the first end 46 of the actuator bar 42 when the actuator bar 42 is in the tripped position. Importantly, no electrical communication to the overload sensing circuitry 28 is required in order to indicate whether automatic resetting is desired, automatic resetting may be effected solely by controlling the follower 66.

The above description has been that of a preferred embodiment of the present invention. It will occur to those who practice the art that many modifications may be made without departing from the spirit and scope of the invention. In order to apprise the public of the various embodiments that may fall within the scope of the invention, the following claims are made:

I claim:

1. A bi-stable relay comprising:

a switch conducting electrical current when closed and preventing the conduction of electrical current when open;

an actuator bar means for moving between a first and second position and linked to the switch to close and open the switch with such movement;

a spring means for biasing the actuator bar means to the second position;

a yoke member abutting the actuator bar means in the first position and magnetically attracting the same against the bias of the spring means when the actuator bar means is in the first position;

a coil in proximity with the yoke member wherein an electrical current passing through the coil may produce a magnetic field reducing the magnetic attraction between the yoke member and the actuator bar means when the later is in the first position thereby allowing the latter to move to the second position under the influence of the spring;

a test means communicating with the actuator bar for moving the actuator bar from the first position to the second position regardless of electrical current passing through the coil;

a follower attachable by magnetic attraction to the actuator bar means so as to be able to move with the movement of the actuator bar means between the first and second positions; and a reset means for moving the follower when so attached to the actuator bar means so as to move the actuator bar means from the second position to the first position.

2. The bi-stable relay of claim 1 wherein the follower passes through the coil and wherein the reducing magnetic field of the coil also reduces the magnetic attraction between the follower and the actuator bar means.

3. The bi-stable relay of claim 1 wherein the actuator bar means is ferromagnetic and wherein the yoke member is permanently magnetic.

4. The bi-stable relay of claim 1 wherein the contacts open when the actuator bar moves to the second position.

5. The bi-stable relay of claim 1 wherein the yoke member is a U-shaped magnet and wherein the actuator bar pivots on one leg of the U to complete a magnetic circuit by joining both legs of the U when the yoke member is in the first position.

6. A bi-stable relay comprising:

a switch conducting electrical current when closed and preventing the conduction of electrical current when open;

an actuator bar means for moving between a first and second position and linked to the switch to close and open the switch with such movement;

a spring means or biasing the actuator bar means to the second position;

a latch holding the actuator bar means against the bias of the spring means when the actuator bar means is in the first position in a first state and releasing the actuator bar means to move to the second position when in a second state;

a follower attachable by magnetic attraction to the actuator bar means so as to be able to move with the movement of the actuator bar means between the first and second positions; and a reset means for moving the follower when so attached to the actuator bar means so as to move the actuator bar means from the second position to the first position.

7. The bi-stable relay of claim 6 wherein the follower passes through a coil and wherein the coil may produce a magnetic field reducing the magnetic attraction between the follower and the actuator bar means.

8. The bi-stable relay of claim 6 including in addition a releasable catch means having a catch position in which movement of the follower with movement of the actuator arm from the first to the second position is prevented.

9. A bi-stable relay comprising:

a switch conducting electrical current when closed and preventing the conduction of electrical current when open;

an actuator bar means for moving between a first and second position and linked to the switch to close and open the switch with such movement;

a spring means for biasing the actuator bar means to the second position;

a yoke member abutting the actuator bar means in the first position and magnetically attracting the same against the bias of the spring means when the actuator bar means is in the first position, wherein the yoke member is a U-shaped magnet and wherein the actuator bar pivots on one leg of the U to complete a magnetic circuit by joining both legs of the U when the yoke member is in the first position;

a coil wound around the yoke member wherein an electrical current passing through the coil may produce a magnetic field reducing the magnetic attraction between the yoke member and the actuator bar means when the latter is in the first position thereby allowing the latter to move to the second position under the influence of the spring; and a test means communicating with the actuator bar for moving the actuator bar from the first position to the second position regardless of electrical current passing through the coil.

* * * * *